US011839239B2

(12) United States Patent
Shoched

(10) Patent No.: US 11,839,239 B2
(45) Date of Patent: Dec. 12, 2023

(54) ADJUSTABLE AIRFLOW CARTRIDGE FOR ELECTRONIC VAPORIZER

(71) Applicant: DES Products Ltd., Lambertville, MI (US)

(72) Inventor: Dana E. Shoched, Lambertville, MI (US)

(73) Assignee: DES PRODUCTS LTD., Lambertville, MI (US)

( * ) Notice: Subject to any disclaimer, the term of this patent is extended or adjusted under 35 U.S.C. 154(b) by 97 days.

(21) Appl. No.: 17/391,942

(22) Filed: Aug. 2, 2021

(65) Prior Publication Data

US 2022/0046992 A1 Feb. 17, 2022

Related U.S. Application Data

(60) Provisional application No. 63/064,797, filed on Aug. 12, 2020.

(51) Int. Cl.

| | |
|---|---|
| ***A24F 40/10*** | (2020.01) |
| ***A24F 40/485*** | (2020.01) |
| ***A24F 40/42*** | (2020.01) |
| ***A24F 40/46*** | (2020.01) |
| ***A24F 40/60*** | (2020.01) |

(Continued)

(52) U.S. Cl.

CPC ..... *A24F 40/485* (2020.01); *A24F 7/00* (2013.01); *A24F 40/10* (2020.01); *A24F 40/42* (2020.01); *A24F 40/46* (2020.01); *A24F 40/60* (2020.01); *H05B 3/18* (2013.01); *H05B 2203/021* (2013.01)

(58) Field of Classification Search

None

See application file for complete search history.

(56) References Cited

U.S. PATENT DOCUMENTS

| | | | |
|---|---|---|---|
| 2,057,353 | A | 10/1936 | Whittemore, Jr. |
| 2,764,154 | A | 9/1956 | Murai |
| 2,860,638 | A | 11/1958 | Bartolomeo |

(Continued)

FOREIGN PATENT DOCUMENTS

| | | | |
|---|---|---|---|
| CN | 1126914 | C | 11/2003 |
| CN | 2719043 | Y | 8/2005 |

(Continued)

*Primary Examiner* — Kelly M Gambetta
*Assistant Examiner* — Katherine A Will
(74) *Attorney, Agent, or Firm* — Volpe Koenig

(57) ABSTRACT

An adjustable airflow cartridge for vaporizing liquids is provided herein featuring a top section including a mouthpiece, a middle section including a tank, a bottom section including a heating element and at least one adjustable intake air aperture, a tube extending from the bottom section through the tank to the mouthpiece, and a rotatable portion on the bottom section that when rotated is configured to increase or decrease a size of at least one adjustable intake air aperture. Air may flow through the adjustable airflow cartridge from the bottom section to the top section by flowing through at least one adjustable intake air aperture, through the heating element, and through the tube to the mouthpiece. In addition, the amount of air that may flow through the at least one adjustable intake air aperture may be adjusted based upon a rotation of the rotatable portion by a user.

9 Claims, 5 Drawing Sheets

(51) Int. Cl.
*H05B 3/18* (2006.01)
*A24F 7/00* (2006.01)

(56) References Cited

U.S. PATENT DOCUMENTS 3,142,319 A 7/1964 Russo
3,200,819 A 8/1965 Gilbert
4,083,372 A 4/1978 Boden
4,171,000 A 10/1979 Uhle
4,284,089 A 8/1981 Ray
4,454,877 A 6/1984 Miller et al.
4,735,217 A 4/1988 Gerth et al.
4,765,347 A 8/1988 Sensabaugh, Jr. et al.
4,771,796 A 9/1988 Myer
4,993,436 A 2/1991 Bloom, Jr.
5,144,962 A 9/1992 Counts et al.
5,159,940 A 11/1992 Hayward et al.
5,687,710 A 11/1997 Ambrosio et al.
5,865,185 A 2/1999 Collins et al.
6,083,962 A 7/2000 Rose et al.
6,196,218 B1 3/2001 Voges
7,117,867 B2 10/2006 Cox et al.
7,726,320 B2 6/2010 Robinson et al.
7,845,359 B2 12/2010 Montaser
7,997,280 B2 8/2011 Rosenthal
8,156,944 B2 4/2012 Har
8,205,622 B2 6/2012 Par
8,365,742 B2 2/2013 Hon
8,375,957 B2 2/2013 Hon
8,442,390 B2 5/2013 Nichols et al.
8,851,068 B2 10/2014 Cohen et al.
8,893,726 B2 11/2014 Hon
8,899,240 B2 12/2014 Mass
9,022,026 B2 5/2015 Fang
9,101,729 B2 8/2015 Liu
9,277,768 B2 3/2016 Xiu
9,301,549 B2 4/2016 Liu
9,308,336 B2 4/2016 Newton
9,320,300 B2 4/2016 Hon
9,364,800 B2 6/2016 Dubief
9,427,536 B2 8/2016 Fang
9,456,632 B2 10/2016 Hon
9,497,998 B2 11/2016 Chen
9,555,198 B2 1/2017 Yang et al.
9,572,373 B2 2/2017 Chen
9,603,390 B2 3/2017 Xu
9,661,878 B2 5/2017 Liu
9,814,266 B2 11/2017 Liu
9,814,269 B2 11/2017 Li et al.
9,814,272 B2 11/2017 Li et al.
9,848,649 B2 12/2017 Li et al.
9,861,129 B2 1/2018 Liu et al.
9,861,132 B2 1/2018 Li et al.
9,943,108 B2 4/2018 Lord
9,968,135 B2 5/2018 Liu
9,974,335 B2 5/2018 Lord
9,974,338 B2 5/2018 Alarcon et al.
9,980,515 B2 5/2018 Milin
9,980,517 B2 5/2018 Zhu
9,986,769 B1 6/2018 Liu et al.
9,993,028 B2 6/2018 Li et al.
9,999,248 B2 6/2018 Liu
9,999,250 B2 6/2018 Minskoff et al.
9,999,252 B2 6/2018 Liu
9,999,254 B2 6/2018 Liu
10,004,259 B2 6/2018 Sebastian et al.
10,039,326 B2 8/2018 Wu
10,058,129 B2 8/2018 Monsees et al.
10,070,662 B2 9/2018 Gorilovsky
10,076,139 B2 9/2018 Monsees et al.
10,085,484 B2 10/2018 Li et al.
10,136,675 B2 11/2018 Li et al.
10,143,233 B2 12/2018 Dubief et al.
10,159,282 B2 12/2018 Monsees et al.
10,244,793 B2 4/2019 Monsees et al.
10,278,421 B2 5/2019 Lord
10,279,934 B2 5/2019 Christensen et al.
10,285,444 B2 5/2019 Clemens et al.
10,285,445 B2 5/2019 Metz et al.
10,306,926 B2 6/2019 Borkovec
10,306,929 B2 6/2019 Liu
10,349,678 B2 7/2019 Chen
10,357,623 B2 7/2019 Fang
10,383,367 B2 8/2019 Rasmussen et al.
10,397,981 B2 8/2019 Liu
10,405,582 B2 9/2019 Hatton et al.
10,462,849 B1 * 10/2019 Reichert ..... A24F 40/46
10,512,284 B2 12/2019 Wang et al.
10,524,518 B1 1/2020 Tygett
10,561,178 B2 2/2020 Brinkley et al.
10,701,974 B2 7/2020 Rosser
10,721,965 B2 7/2020 Lipowicz
10,791,762 B2 10/2020 Liu
10,791,763 B2 10/2020 Chen
10,792,685 B2 10/2020 Tong
10,834,969 B2 11/2020 Godfrey et al.
10,865,095 B2 12/2020 Scott et al.
10,945,455 B1 3/2021 Wang
11,033,055 B2 6/2021 Fraser et al.
11,051,549 B2 7/2021 Borkovec
11,064,739 B2 7/2021 Gimkiewicz et al.
11,208,240 B2 12/2021 Biel et al.
2004/0074984 A1 4/2004 Martens, III et al.
2005/0016550 A1 1/2005 Katase
2005/0252177 A1 11/2005 Ishikawa
2006/0016453 A1 1/2006 Kim
2006/0175425 A1 8/2006 McGee et al.
2006/0191546 A1 8/2006 Takano et al.
2006/0196518 A1 9/2006 Hon
2007/0267031 A1 11/2007 Hon
2007/0286816 A1 12/2007 Hale et al.
2008/0092912 A1 4/2008 Robinson et al.
2008/0283048 A1 11/2008 Petersen
2008/0283049 A1 11/2008 Mahoney et al.
2009/0095311 A1 4/2009 Han
2009/0126745 A1 5/2009 Hon
2009/0133691 A1 5/2009 Yamada et al.
2010/0001090 A1 1/2010 Neergaard et al.
2010/0200008 A1 8/2010 Taieb
2010/0242974 A1 9/2010 Pan
2011/0011396 A1 1/2011 Fang
2012/0279512 A1 11/2012 Hon
2013/0037041 A1 2/2013 Worm et al.
2013/0152922 A1 6/2013 Benassayag et al.
2013/0192623 A1 8/2013 Tucker et al.
2013/0255675 A1 10/2013 Liu
2014/0150785 A1 6/2014 Malik et al.
2015/0090280 A1 4/2015 Chen
2015/0090281 A1 4/2015 Chen
2015/0150307 A1 6/2015 Liu
2015/0157055 A1 6/2015 Lord
2015/0181943 A1 7/2015 Li et al.
2015/0272218 A1 10/2015 Chen
2015/0296887 A1 10/2015 Zhu
2015/0320116 A1 * 11/2015 Bleloch ..... A61M 11/042 219/628
2015/0335073 A1 11/2015 Li et al.
2016/0135505 A1 5/2016 Li et al.
2016/0143358 A1 5/2016 Zhu
2016/0157522 A1 6/2016 Zhu
2016/0192707 A1 7/2016 Li et al.
2016/0324216 A1 11/2016 Li et al.
2016/0366947 A1 12/2016 Monsees et al.
2016/0374393 A1 12/2016 Chen
2017/0049153 A1 2/2017 Guo et al.
2017/0347712 A1 12/2017 Singh
2017/0347714 A1 12/2017 Metz et al.
2018/0027874 A1 * 2/2018 Zhu ..... F22B 1/284
2018/0027881 A1 2/2018 Chen
2018/0263294 A1 9/2018 Qiu
2018/0303165 A1 10/2018 Schuler et al.
2018/0360126 A1 12/2018 Chen
2018/0368472 A1 * 12/2018 Mishra ..... A24B 15/167
2019/0254345 A1 8/2019 Hepworth et al.

(56) References Cited

U.S. PATENT DOCUMENTS

| | | | | |
|---|---|---|---|---|
| 2019/0274360 | A1 | 9/2019 | Liu et al. | |
| 2019/0373954 | A1 | 12/2019 | Rado | |
| 2020/0015524 | A1 | 1/2020 | Rado | |
| 2020/0221769 | A1* | 7/2020 | Davis | B23P 19/10 |
| 2021/0107710 | A1 | 4/2021 | Biel et al. | |

FOREIGN PATENT DOCUMENTS

| | | | |
|---|---|---|---|
| CN | 1241473 | C | 2/2006 |
| CN | 2889333 | Y | 4/2007 |
| CN | 200966824 | Y | 10/2007 |
| CN | 201018927 | Y | 2/2008 |
| CN | 100381083 | C | 4/2008 |
| CN | 201061262 | Y | 5/2008 |
| CN | 201064185 | Y | 5/2008 |
| CN | 201067079 | Y | 6/2008 |
| CN | 201076006 | Y | 6/2008 |
| CN | 201085044 | Y | 7/2008 |
| CN | 201088138 | Y | 7/2008 |
| CN | 201094280 | Y | 8/2008 |
| CN | 201104488 | Y | 8/2008 |
| CN | 101268867 | A | 9/2008 |
| CN | 201127292 | Y | 10/2008 |
| CN | 201146824 | Y | 11/2008 |
| CN | 201188868 | Y | 2/2009 |
| CN | 201207922 | Y | 3/2009 |
| CN | 201226775 | Y | 4/2009 |
| CN | 201238610 | Y | 5/2009 |
| CN | 101518361 | B | 9/2009 |
| CN | 201379073 | Y | 1/2010 |
| CN | 201430916 | Y | 3/2010 |
| CN | 201986689 | U | 9/2011 |
| CN | 103462224 | A | 12/2013 |
| CN | 203435688 | U | 2/2014 |
| CN | 203457801 | U | 3/2014 |
| CN | 203492784 | U | 3/2014 |
| CN | 203523811 | U | 4/2014 |
| CN | 103859604 | A | 6/2014 |
| CN | 203662025 | U | 6/2014 |
| CN | 103948174 | A | 7/2014 |
| CN | 103960782 | A | 8/2014 |
| CN | 203762290 | U | 8/2014 |
| CN | 203828070 | U | 9/2014 |
| CN | 203952431 | U | 11/2014 |
| CN | 203969206 | U | 12/2014 |
| CN | 204070538 | U | 1/2015 |
| CN | 204070577 | U | 1/2015 |
| CN | 204104827 | U | 1/2015 |
| CN | 204104843 | U | 1/2015 |
| CN | 204120238 | U | 1/2015 |
| CN | 204191595 | U | 3/2015 |
| CN | 204217916 | U | 3/2015 |
| CN | 204317492 | U | 5/2015 |
| CN | 204335821 | U | 5/2015 |
| CN | 204392600 | U | 6/2015 |
| CN | 104770899 | A | 7/2015 |
| CN | 204465900 | U | 7/2015 |
| CN | 204483035 | U | 7/2015 |
| CN | 104824853 | A | 8/2015 |
| CN | 104824854 | A | 8/2015 |
| CN | 204540816 | U | 8/2015 |
| CN | 104886779 | A | 9/2015 |
| CN | 104886785 | A | 9/2015 |
| CN | 104939320 | A | 9/2015 |
| CN | 104939324 | A | 9/2015 |
| CN | 204653779 | U | 9/2015 |
| CN | 204670383 | U | 9/2015 |
| CN | 105054308 | A | 11/2015 |
| CN | 105212278 | A | 1/2016 |
| CN | 204930387 | U | 1/2016 |
| CN | 105310114 | A | 2/2016 |
| CN | 205180359 | U | 4/2016 |
| CN | 205266968 | U | 6/2016 |
| CN | 105768233 | A | 7/2016 |
| CN | 106535675 | B | 3/2017 |
| CN | 206025222 | U | 3/2017 |
| CN | 107019241 | B | 8/2017 |
| CN | 107072307 | B | 8/2017 |
| CN | 206791644 | U | 12/2017 |
| CN | 110191649 | A | 8/2019 |
| CN | 111109663 | A | 5/2020 |
| CN | 111759008 | A | 10/2020 |
| DE | 202014011292 | U1 | 2/2019 |
| EP | 0794838 | | 9/1997 |
| EP | 0845220 | | 6/1998 |
| EP | 1609376 | | 12/2005 |
| EP | 2682011 | | 1/2014 |
| EP | 2888963 | A1 | 7/2015 |
| EP | 3205597 | | 8/2017 |
| EP | 3381304 | | 10/2018 |
| EP | 2888963 | B1 | 2/2019 |
| JP | 2005-034021 | A | 2/2005 |
| JP | 2018-504886 | A | 2/2018 |
| JP | 2018-509884 | A | 4/2018 |
| KR | 0163472 | B1 | 11/1998 |
| KR | 100469625 | B1 | 2/2005 |
| KR | 20090003871 | U | 4/2009 |
| KR | 20110006928 | U | 7/2011 |
| KR | 101623769 | B1 | 5/2016 |
| KR | 20180136534 | A | 12/2018 |
| NO | 2013/113173 | A1 | 8/2013 |
| WO | 2005/020726 | | 3/2005 |
| WO | 2008/138650 | | 11/2008 |
| WO | 2008/139411 | | 11/2008 |
| WO | 2011/146318 | A1 | 11/2011 |
| WO | 2013/110211 | A1 | 8/2013 |
| WO | 2014/101401 | A1 | 7/2014 |
| WO | 2015/043134 | A1 | 4/2015 |
| WO | 2015/109476 | A1 | 7/2015 |
| WO | 2016/065532 | A1 | 5/2016 |
| WO | 2016/065599 | A1 | 5/2016 |
| WO | 2016/082179 | A1 | 6/2016 |
| WO | 2016/119163 | A1 | 8/2016 |
| WO | 2016/123780 | A1 | 8/2016 |
| WO | 2016/127406 | A1 | 8/2016 |
| WO | 2018/054388 | A1 | 3/2018 |
| WO | 2018/223290 | A1 | 12/2018 |

* cited by examiner

ADJUSTABLE AIRFLOW CARTRIDGE FOR ELECTRONIC VAPORIZER

CROSS REFERENCE TO RELATED APPLICATION

This application claims the benefit of U.S. Provisional Application No. 63/064,797, filed on Aug. 12, 2020, which is incorporated by reference as if fully set forth.

FIELD OF INVENTION

The present invention relates to electronic vaporizers, and more particularly to adjustable airflow cartridges configured for use within electronic vaporizers.

BACKGROUND

Cartridges for holding liquids and vape oils within electronic vaporizers are known in the art. Currently on the market, some cartridges provide a limited range of airflow to a user, thereby restricting the vaping experience and customizability relative to user preferences for high or low viscosity oils, flavor and vapor cloud production. Accordingly, there is a need for a cartridge that offers variability in the airflow by providing additional functionality to allow a user to determine the optimal amount of air that passes through the cartridge when the user draws air through the cartridge via the mouthpiece of the cartridge. Such functionality may enhance a user's experience with an electronic vaporizer by providing optionality relative to adjusting the size of one or more adjustable intake air apertures based upon the configuration of the cartridge.

SUMMARY

There is provided according to the embodiments of the invention an adjustable airflow cartridge for vaporizing liquids comprising a top section including a mouthpiece, a middle section including a tank, a bottom section including a heating element and at least one adjustable intake air aperture, a tube extending from the bottom section through the tank to the mouthpiece, and a rotatable portion on the bottom section that when rotated is configured to increase or decrease a size of the at least one adjustable intake air aperture. Air may flow through the adjustable airflow cartridge from the bottom section to the top section by flowing through at least one adjustable intake air aperture, through the heating element, and through the tube to the mouthpiece. In addition, an amount of air that may flow through at least one adjustable intake air aperture may be adjusted based upon a rotation of the rotatable portion by a user.

In an embodiment, the adjustable airflow cartridge of the embodiments described herein may also provide for faster vaporization with maximum vapor and purer taste based upon the location of the atomizer with respect to ceramic glazed wires.

In another embodiment, the adjustable airflow cartridge may feature a porous ceramic heating element that may enable the adjustable airflow cartridge to vaporize liquids and oils at lower temperatures to provide for enhanced flavors and cleaner tasting terpene profiles of the liquids and oils.

In another embodiment, the structure of the adjustable airflow cartridge may create a larger surface area of a microporous ceramic material contributing to enhance the taste and flavor for the user during vaping.

In yet another embodiment, the heating element may include an embedded coil that is surrounded by a particular ceramic material that may provide protection for the oil or resin within the cartridge that is heated for vaping.

In an embodiment, one or more adjustable intake air apertures in the metallic housing of the bottom section of the cartridge may provide a customizable airflow to a user.

In another embodiment, a portion of the bottom section of the cartridge including an adjustable air flow collar comprising one or more adjustable intake air apertures may be rotated or twisted by a user to adjust the airflow through the one or more adjustable intake air apertures.

In another embodiment, the cartridge including one or more adjustable intake air apertures may feature a slidable collar that a user may slide up and down the exterior housing of the cartridge to increase or decrease the size of the one or more adjustable intake air apertures.

In yet another embodiment, the cartridge including one or more adjustable intake air apertures may feature a lever that rotates a cover for the one or more adjustable intake air apertures, thereby increasing or decreasing the size of the one or more adjustable intake air apertures.

These and other objects, features and advantages will be apparent from the following detailed description of illustrative embodiments thereof, which is to be read in connection with the accompanying drawings.

BRIEF DESCRIPTION OF THE DRAWINGS

A more detailed understanding may be had from the following description, given by way of example in conjunction with the accompanying drawings herein.

DETAILED DESCRIPTION OF THE PREFERRED EMBODIMENTS

Figure 1:
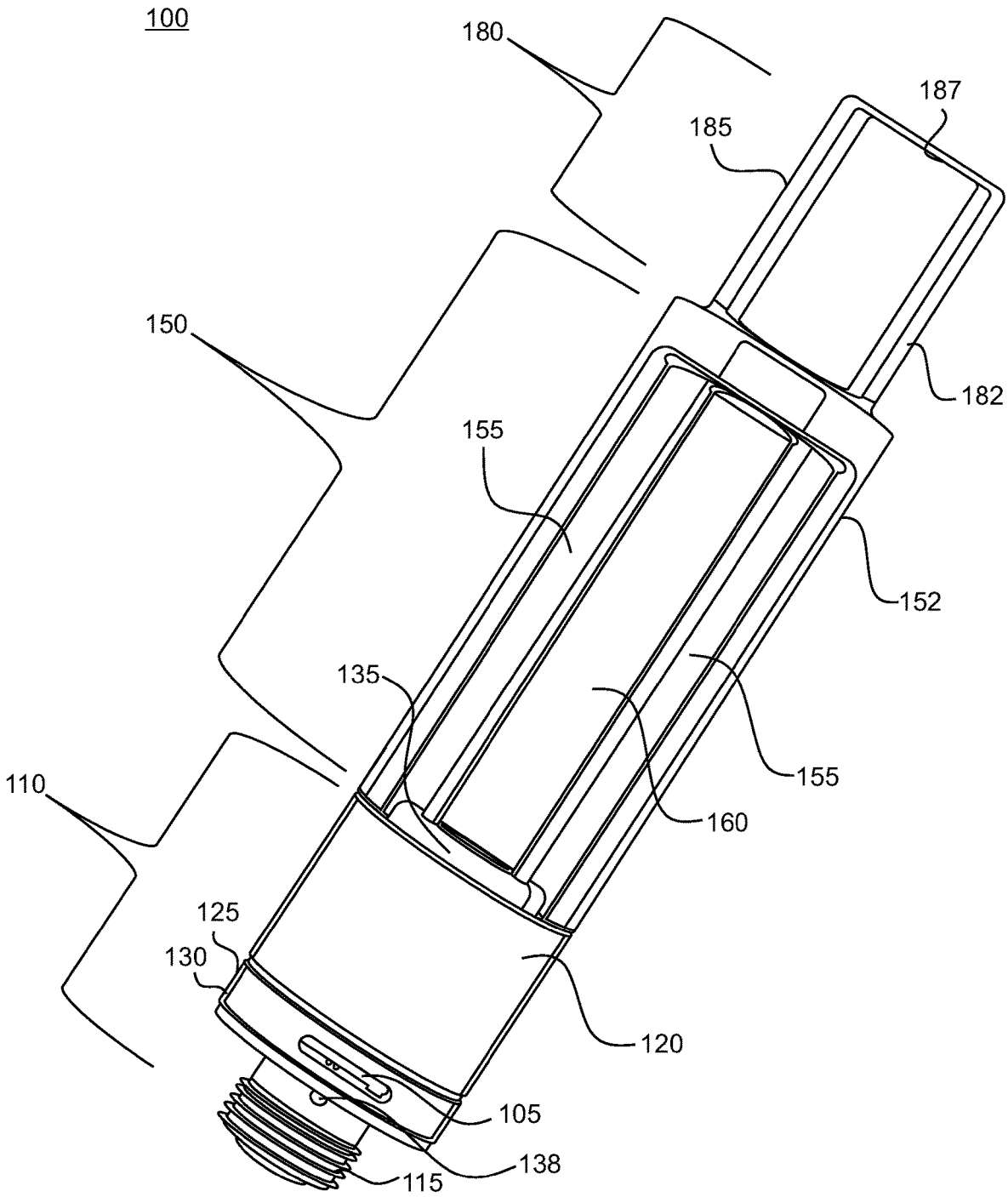
FIG. 1 shows a perspective view of an adjustable airflow cartridge of the herein described embodiments.

Various embodiments are described herein where like references to figures are used to describe like features. Each feature or element may be used alone without other features and elements or in various combinations with or without other features and elements.

The present embodiments relate to an adjustable airflow cartridge for use within electronic vaporizers. In general, a vaporizer device utilizes a battery that powers the heating device or atomizer, which vaporizes a liquid held inside a cartridge. Cartridges for electronic vaporizers are utilized for holding liquids and vape oils that are heated by the adjacent atomizer to produce vapors within the airway leading to the mouthpiece of the electronic vaporizer. The cartridge may be coupled to the battery of an electronic vaporizer by screwing the cartridge into the battery with 510 threading, for example.

Liquid from the cartridge flows to the atomizer, which is vaporized at a temperature level, determined, in part, by the voltage from the battery. When a user applies suction to the mouthpiece of the vaporizer, air moves into the cartridge through an adjustable air intake aperture located at the bottom section of the cartridge. At a point when a user draws air through the mouthpiece, air may pass through one or more adjustable intake air apertures, through the cartridge to the mouthpiece. A vaporizer generally utilizes convection heating to heat the air within the cartridge to a certain temperature; when the heated air passes through the liquid, the liquid is vaporized. Particular liquids and vape oils may be added to the cartridge based upon user preferences, such as flavor and vaporization properties.

The cartridge may feature a housing that may be made of quartz glass, where the housing encases both a top section comprising a mouthpiece and a middle section including a tank for maintaining a liquid or vape oil. In addition, the cartridge may further include a center tube that may be made of quartz glass. The center tube may extend through the tank to provide an airway extending from the mouthpiece to a bottom section of the cartridge.

The bottom section of the cartridge may feature a housing that adjoins the housing of the middle section. The housing of the bottom section may be metallic and may also feature an adjustable air flow collar comprising one or more adjustable intake air apertures that provides air intake through the housing of the bottom section. When a user draws air through the mouthpiece, air may pass through the one or more adjustable intake air apertures, through the atomizer and liquid or vape oil, and then through the center tube to the mouthpiece. The adjustable air flow collar comprising the one or more adjustable intake air apertures may be positioned adjacent to 510 threading on the housing of the bottom section, where the 510 threading may be utilized for screwing the cartridge into a battery. The interior of the bottom section may include a heating element with porous ceramic material, where the heating element may comprise a heat resistant wire such as a Kanthal® wire embedded in a porous ceramic material.

The adjustable air flow collar, comprising the one or more adjustable intake air apertures in the housing of the bottom section of the cartridge, may provide a customizable airflow to a user. In an embodiment, a portion of the bottom section including the adjustable air flow collar comprising one or more adjustable intake air apertures may be rotated or twisted by a user to adjust the airflow through the one or more adjustable intake air apertures. In another embodiment, the cartridge may feature a slidable collar that a user may slide up and down the exterior housing of the cartridge to increase or decrease the size of the adjustable intake air apertures. In yet another embodiment, the cartridge may feature a lever that rotates a cover for the adjustable intake air apertures, thereby increasing or decreasing the size of the one or more adjustable intake air apertures.

In general, the level of airflow between the one or more adjustable intake air apertures of the bottom section of the cartridge and the mouthpiece of the top section of the cartridge may determine the user's experience with an electronic vaporizer. A user's preference in the range of airflow through an adjustable intake air aperture of the bottom section may depend, in part, upon whether the oil within the tank is a high or low viscosity oil, whether the user desires more or less flavor from a particular oil or liquid, or if more vapor production is desired. By altering the airflow through the one or more adjustable intake air apertures of the bottom section, a user's experience may be customized. For example, to enhance vapor production while moderating the flavor, a user may twist or rotate the portion of the bottom section featuring the adjustable air flow collar comprising the one or more adjustable intake air apertures to increase the airflow through the one or more adjustable intake air apertures. Likewise, to reduce vapor production while enhancing the flavor, a user may twist or rotate the portion of the bottom section featuring the adjustable air flow collar comprising the one or more adjustable intake air apertures to decrease the airflow through the one or more adjustable intake air apertures.

In particular, a user may twist or rotate the adjustable air flow collar comprising the one or more adjustable intake air apertures so that the size of the one or more air apertures reciprocally adjusts between larger apertures providing increased airflow and smaller apertures providing decreased airflow. As such, the adjustable airflow cartridge may provide flexibility and customizability by enabling a user to selectively determine a desired airflow, based upon the ability to reciprocally adjust between sizes of the one or more adjustable intake air apertures within the metallic housing of the bottom section of the cartridge.

As aforementioned, the top and middle sections of the adjustable airflow cartridge may feature a quartz glass housing, while the bottom section with one or more adjustable intake air apertures and 510 threading may feature a metallic exterior. In an embodiment in which the whole tank of the middle section, including both the quartz glass housing and quartz glass center tube, is comprised of glass, metal elements do not contact the liquid or vape oil within the cartridge.

Metallic portions of the adjustable airflow cartridge may comprise a ceramic coating featuring a range of thickness of 1-2 microns. The ceramic coating may provide protection against heavy metals within the components of the cartridge from absorbing into the vapors during vaporization of liquids and oils within the cartridge. In an embodiment in which the top and middle sections also feature a metallic structure, it is understood that a ceramic coating on such top and middle sections may also provide protection against heavy metals absorbing into the vapors during vaporization of liquids and oils within the cartridge.

In other embodiments, the range of thickness of the ceramic coating over metallic portions of the adjustable airflow cartridge may be larger than 1-2 microns, or it may be smaller than 1-2 microns.

The ceramic coating of the embodiments described herein may also comprise a zirconium nitride coating. In one embodiment, the metal components of the cartridge may be exclusively coated in a layer of zirconium nitride.

The adjustable airflow cartridge of the embodiments described herein may also provide for faster heating of the liquids and vape oils within the cartridge, enhanced vapor volume and improved taste for the user. The ceramic heating element comprising porous ceramic material may also accommodate the properties of the liquids and vape oils within the cartridge, so that the cartridge is suitable for CBD/THC/or essential oil quantities.

The structure of the adjustable airflow cartridge described herein may also provide for an improved vaping experience in terms of the time required to produce a quality vapor and the flavor of the vapor.

The adjustable airflow cartridge herein provides for improved customization of a user's experience with an electronic vaporizer based upon the determination of the airflow through one or more adjustable intake air apertures of the cartridge. Further, the adjustable airflow cartridge described herein may also feature structural features that provide for an enhanced vape experience in terms of safety, flavor and heating and vaping efficiency.

FIG. 1 shows an example embodiment of an adjustable airflow cartridge 100. The adjustable airflow cartridge 100 shown in FIG. 1 is oriented diagonally and may feature a bottom section 110 with at least one adjustable intake air aperture 105 and 510 threading 115 for screwing the adjustable airflow cartridge 100 into a battery. The bottom section 110 may further include a heating element with porous ceramic material, where the heating element may comprise a heat resistant wire, such as a Kanthal® wire embedded in the porous ceramic material.

Referring again to FIG. 1, the adjustable airflow cartridge 100 may further include a middle section 150 including a tank 155 for holding a liquid or vape oil. A center tube 160, that may be comprised of quartz glass, may extend through the tank 155 to provide an airway from the bottom section 110 of the adjustable airflow adjustable airflow cartridge 100 to a mouthpiece 185 with opening 187 at the top section 180 of the cartridge. Because the center tube 160 may extend through the tank 155 of the middle section 150, the perspective view of FIG. 1 illustrates the tank 155 on either side of the center tube 160 that extends through the tank 155.

As further shown in FIG. 1, each of the top 180 and middle 150 sections of the adjustable airflow cartridge 100 may feature a respective housing 182, 152 that may be made of quartz glass. The housing 182 of the top section 180 may extend to and adjoin the housing 152 of the middle section 150. In addition, the housing 152 of the middle section 150 may extend to and adjoin an exterior 120 of the bottom section 110. In relation to the center tube 160 that may also be comprised of quartz glass, as shown in FIG. 1, the housing 182 of the top section 180 and the housing 152 of the middle section 150 may each feature an inside diameter that is larger than the outside diameter of the center tube 160. As such, the center tube 160 may be disposed within the housing 152 of the middle section 150, as illustrated in FIG. 1. In addition, as further shown in FIG. 1, the tank 155 may reside between the interior of the housing 152 of the middle section 150 and the exterior surface of the center tube 160. Accordingly, the perspective view of FIG. 1 illustrates the tank 155 on either side of the center tube 160 that extends through the tank 155.

Referring again to FIG. 1, the exterior 120 of the bottom section 110 may be comprised of a metallic material. As further shown in FIG. 1, the bottom section 110 may feature a seal 135, which may be a silicone O-ring seal. Further, the bottom section 110 may also feature an air hole 138 to provide air flow. The metallic portions of the adjustable airflow cartridge 100 may comprise a ceramic coating featuring a range of thickness of 1-2 microns. The range of thickness of the ceramic coating may be larger than 1-2 microns, or it may be smaller than 1-2 microns. The ceramic coating may provide protection against heavy metals within the components of the adjustable airflow cartridge 100 from absorbing into the vapors during vaporization of liquids and oils within the adjustable airflow cartridge 100. The ceramic coating may also comprise a zirconium nitride coating. In an embodiment, the metal components of the adjustable airflow cartridge 100 may be exclusively coated in a layer of zirconium nitride.

Referring again to the bottom section 110 of the adjustable airflow cartridge 100 shown in FIG. 1, a portion 125 of the bottom section 110 may feature an adjustable air flow collar 130 comprising one or more adjustable intake air apertures 105, where such portion 125 may be twisted or rotated by a user to adjust the amount of airflow through the one or more adjustable intake air apertures 105. As a user rotates or twists the portion 125 of the bottom section 110 featuring the adjustable air flow collar 130 having the one or more adjustable intake air apertures 105, a user may adjust the size of the one or more adjustable intake air apertures 105 to determine an amount of air passing through the one or more adjustable intake air apertures 105. As a user draws air through the mouthpiece 185, air may travel through the one or more adjustable intake air apertures 105, through the atomizer and vape oil, through the center tube 160 of the middle section 150, and to the mouthpiece 185 of the top section 180 of the adjustable airflow cartridge 100. By controlling and determining the level of airflow through the one or more adjustable intake air apertures 105 of the bottom section 110, a user can customize an experience with an electronic vaporizer.

Figure 2:
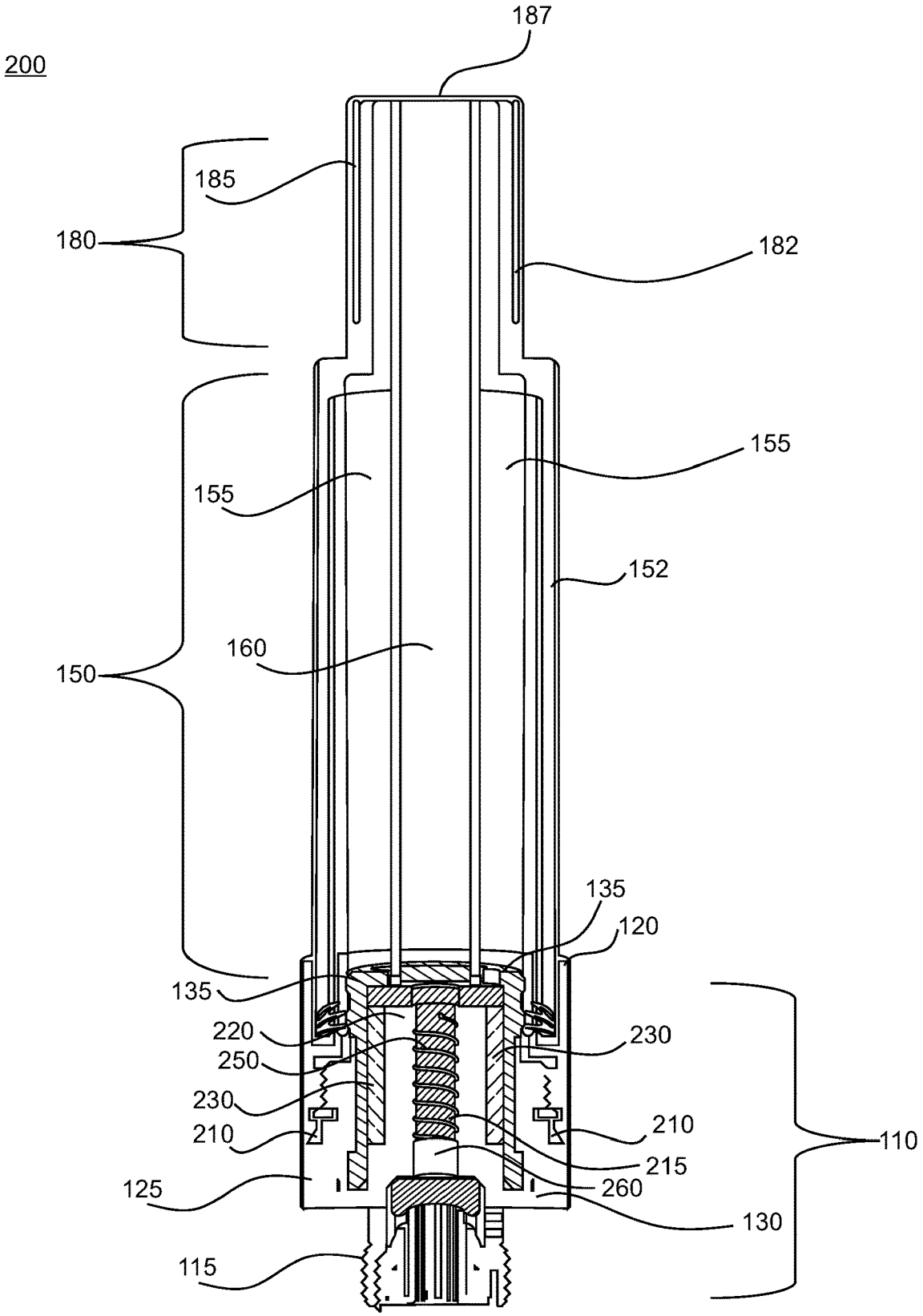
FIG. 2 shows a perspective view of an adjustable airflow cartridge with a heating element with porous ceramic material.

FIG. 2 shows an adjustable airflow cartridge 200 with a housing 182 at a top section 180 comprising a mouthpiece 185 with opening 187, where the housing 182 may be comprised of quartz glass. The housing 182 of the top section 180 may extend to and adjoin the housing 152 of the middle section 150. The middle section 150 may include a tank 155 for maintaining a liquid or vape oil. Within the middle section 150, a center tube 160 that may be made of quartz glass may extend through the tank 155 to provide an airway extending from the mouthpiece 185 to a bottom section 110 of the adjustable airflow cartridge 200. Because the center tube 160 may extend through the tank 155 of the middle section 150, the perspective view of FIG. 2 illustrates the tank 155 on either side of the center tube 160 that extends through the tank 155. In an embodiment, based on a quartz-glass composition of the mouthpiece 185, tank 155, center tube 160, and housings 182, 152, metal elements do not contact the liquid or vape oil within the adjustable airflow cartridge 200.

Referring again to FIG. 2, the bottom section 110 of the adjustable airflow cartridge 200 may feature an exterior 120 that may be metallic that adjoins the housing 152 of the middle section 150. As further shown in FIG. 2, the bottom section 110 may feature a seal 135, which may be a silicone O-ring seal. The metallic portions of the adjustable airflow cartridge 200 may comprise a ceramic coating featuring a range of thickness of 1-2 microns. As aforementioned, the range of thickness of the ceramic coating may be larger than 1-2 microns, or it may be smaller than 1-2 microns. The ceramic coating of the embodiments of FIG. 2 may also comprise a zirconium nitride coating. In another embodiment, the metal components of the adjustable airflow cartridge 200 may be exclusively coated in a layer of zirconium nitride.

As further illustrated in FIG. 2, the bottom section 110 may also include 510 threading 115 for screwing the adjustable airflow cartridge 200 into a battery. The interior of the bottom section 110 may further comprise a ceramic protector 230 for protecting the heating element 220. It should be noted that the ceramic protector may be made out of any material suitable for protecting ceramic, such as cotton. In addition, the heating element 220 may be seated on a sleeve 260, which may be a metal sleeve, and an airway 215 may pass through the heating element 220. The heating element 220 may feature a ceramic material, such as a porous ceramic material, and a coil 250 embedded in the ceramic material. The embedded coil 250 may be comprised of a heat resistant wire, such as a Kanthal® wire. Due to the ceramic heating chamber structure, the adjustable airflow cartridge 200 does not contain heavy metals that may contact the liquid or vape oil within the adjustable airflow cartridge 200.

In addition, the ceramic heating chamber structure of the adjustable airflow cartridge 200 shown in FIG. 2 may increase the surface area of the porous ceramic material of the heating element 220, thereby contributing to an enhanced vape experience and flavor of the vapor production. The enhanced surface area of the porous ceramic material of the ceramic heating element 220 in the adjustable airflow cartridge 200 may also provide for faster heating of the liquids and vape oils within the adjustable airflow cartridge 200, enhanced vapor volume and improved taste for the user. The ceramic protector 230 and heating element 220 with porous ceramic material may also accommodate the properties of the liquids and vape oils within the adjustable airflow cartridge 200, so that the cartridge is suitable for CBD/THC or essential oil quantities.

Referring again to FIG. 2, a portion 125 of the bottom section 110 of the adjustable airflow cartridge 200 may also feature an adjustable air flow collar 130 comprising one or more adjustable intake air apertures, where such portion 125 may be twisted or rotated by a user to adjust the amount of airflow through the one or more adjustable intake air apertures. In particular, as a user rotates or twists the portion 125 of the bottom section 110 featuring the adjustable air flow collar 130 with one or more adjustable intake air apertures, air may travel through the air apertures, through the heating element 220 and vape oil, through the center tube 160 of the middle section 150, and to the mouthpiece 185 of the top section 180 of the adjustable airflow cartridge 200. By controlling and determining the level of airflow through the one or more adjustable intake air apertures of the bottom section 110, a user can customize an experience with an electronic vaporizer.

The adjustable air flow collar 130 shown in the embodiment of FIG. 2 may provide for the ability to adjust the airflow capacity in the adjustable airflow cartridge 200, based upon each draw upon the mouthpiece 185 by a user. For example, to close the adjustable air flow collar 130, a user may twist or rotate the adjustable air flow collar 130 including the one or more adjustable intake air apertures to decrease the airflow through the one or more adjustable intake air apertures. By closing the adjustable air flow collar 130, a user may thereby reduce the airflow to conserve a liquid or oil within the tank 155 of the adjustable airflow cartridge 200 and to reduce vapor production through the mouthpiece 185. Conversely, to open the adjustable air flow collar 130, a user may twist or rotate the adjustable air flow collar 130 including the one or more adjustable intake air apertures to increase the airflow through the one or more adjustable intake air apertures. By opening the adjustable air flow collar 130, a user may thereby increase the airflow to produce maximum airflow through the adjustable airflow cartridge 200 and to increase vapor production through the opening 187 of the mouthpiece 185. The adjustable air flow collar 130 may enable a user to determine a preferred airflow in each draw upon the mouthpiece 185, thereby providing the user enhanced control over a vaping experience. As further illustrated in FIG. 2, the bottom section 110 of the adjustable airflow cartridge 200 may also feature a bearing element 210 that may facilitate rotation of an adjustable air flow collar 130 by a user.

Figure 3:
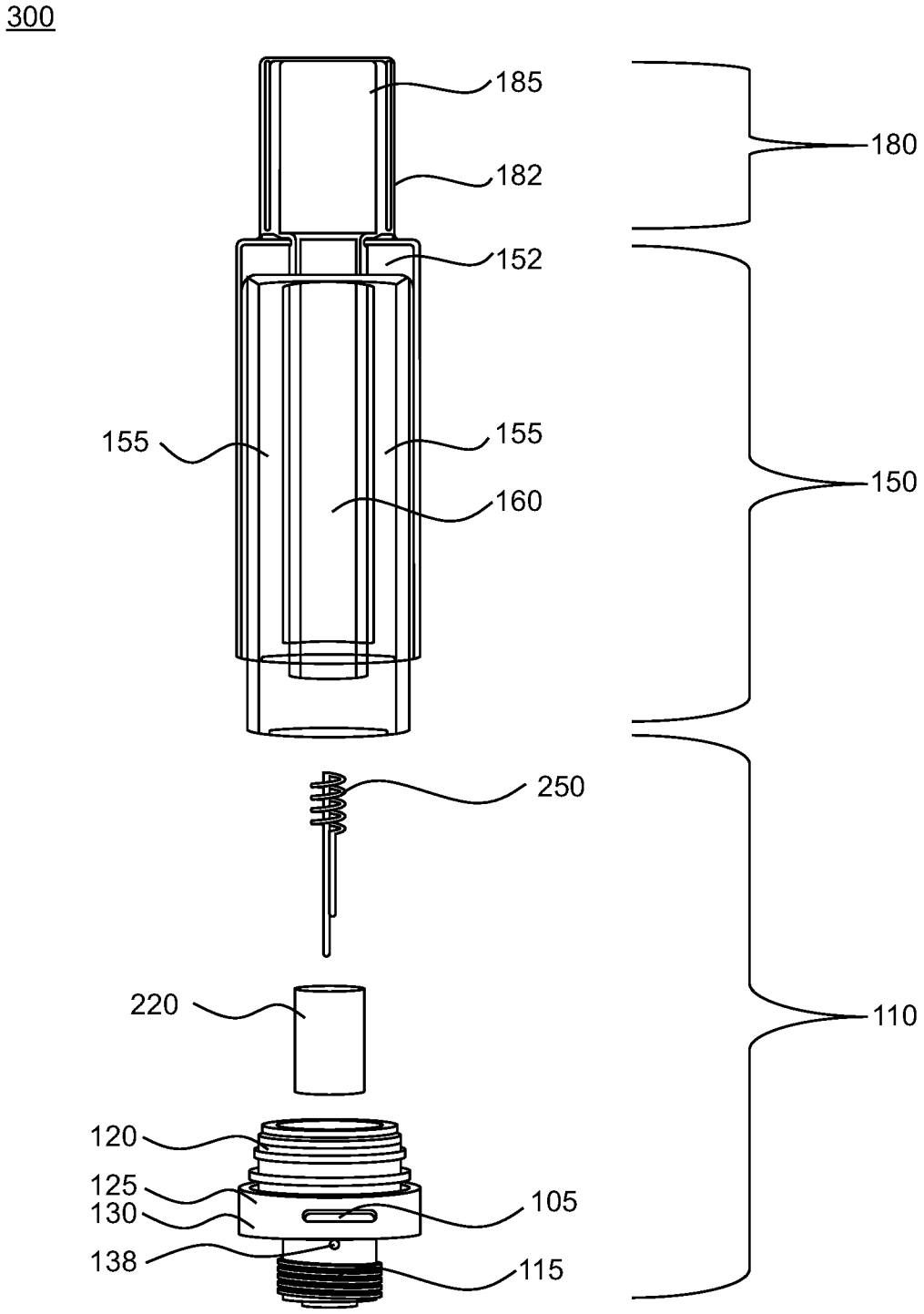
FIG. 3 shows an exploded view of an example adjustable airflow cartridge featuring a heating element with porous ceramic material of the herein described embodiments.

FIG. 3 shows an exploded view of an example adjustable airflow cartridge 300 featuring an adjustable air flow collar 130 comprising one or more adjustable intake air apertures 105 in a bottom section 110 of the herein described embodiments. Although FIG. 3 shows one adjustable intake air aperture 105 in the adjustable air flow collar 130 of the bottom section 110, those of skill in the art would understand that an adjustable airflow cartridge 300 of the herein described embodiments may comprise one or more adjustable intake air apertures 105 in an adjustable air flow collar 130 of the bottom section 110.

The exploded view of FIG. 3 illustrates an exterior 120 of the bottom section 110, which houses the heating element 220 with embedded coil 250 that may be comprised of a heat resistant wire, such as a Kanthal® wire. The heating element 220 may be comprised of a ceramic material, such as a porous ceramic material. As illustrated in the exploded view of FIG. 3, the embedded coil 250 is shown apart from the heating element 220, but it is understood that when the cartridge 300 is assembled for use, the embedded coil 250 is embedded within the porous ceramic material of the ceramic heating element 220. The bottom section 110 comprising the heating element 220 with embedded coil 250 may enable the adjustable airflow cartridge 300 to vaporize liquids and oils at lower temperatures to provide for enhanced flavor and a cleaner tasting terpene profile of the liquids and oils.

In addition, FIG. 3 illustrates how the exterior 120 of the bottom section 110 of the adjustable airflow cartridge 300 may adjoin the housing 152 of the middle section 150 of an electronic vaporizer assembly. In an embodiment, the exterior 120 of the bottom section 110 may be metallic, and the respective housings 152, 182 of the middle 150 and top 180 sections may be made of quartz glass.

As further illustrated in FIG. 3, the middle section 150 of the adjustable airflow cartridge 300 may also feature a tank 155 for maintaining a liquid or vape oil. Within the middle section 150, a center tube 160 that may be made of quartz glass may pass through the tank 155 to provide an airway extending from the bottom section 110 of the adjustable airflow cartridge 300 to a mouthpiece 185 at a top section 180 of the adjustable airflow cartridge 300. In an embodiment, a quartz-glass composition of the mouthpiece 185, tank 155, center tube 160, and housings 182, 152 may enable the adjustable airflow cartridge 300 to eliminate contact between metal elements and the liquid or vape oil within the adjustable airflow cartridge 300.

As depicted in FIG. 3, the housing 182 of the top section 180 may extend to and adjoin the housing 152 of the middle section 150. In addition, the housing 152 of the middle section 150 may extend to and adjoin an exterior 120 of the bottom section 110. The exterior 120 of the bottom section 110 may include 510 threading 115 for screwing the adjustable airflow cartridge 300 into a battery. As further shown in FIG. 3, the bottom section 110 may feature an air hole 138 to provide air flow. The exterior 120 of the bottom section 110 may also be metallic, where the metallic portions of the adjustable airflow cartridge 300 may comprise a ceramic coating featuring a range of thickness of 1-2 microns. As aforementioned, the range of thickness of the ceramic coating may be larger than 1-2 microns, or it may be smaller than 1-2 microns. The ceramic coating of the embodiments of FIG. 3 may also comprise a zirconium nitride coating. In another embodiment, the metal components of the adjustable airflow cartridge 300 may be exclusively coated in a layer of zirconium nitride.

Referring again to FIG. 3, the structure of the heating element 220 with porous ceramic material may create a larger surface area of a porous ceramic material, thereby contributing to an enhanced taste and flavor for the user during vaping. In addition, by rotating or twisting a portion 125 of the bottom section 110 featuring an adjustable air flow collar 130 comprising at least one or more adjustable intake air apertures 105, a user may customize the flavor and vapor production when using the adjustable airflow cartridge 300 of the herein described embodiments.

Figure 4:
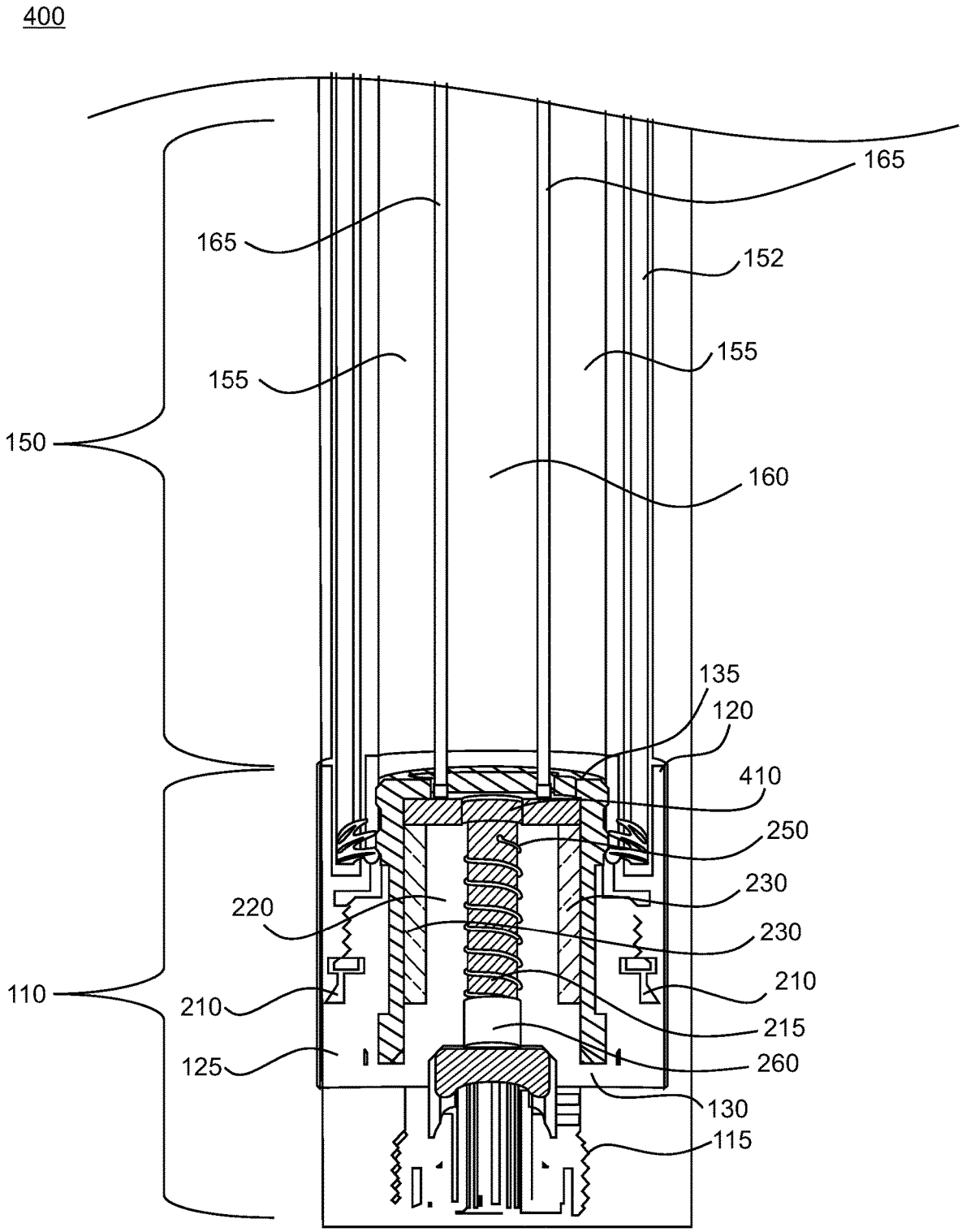
FIG. 4 shows a cross-sectional view of an adjustable airflow cartridge with ceramic heating element and ceramic protector.

The embodiment of FIG. 4 shows a cross-sectional view of an adjustable airflow cartridge 400 with a bottom section 110 having a metallic exterior 120 and middle section 150 featuring a quartz-glass housing 152. As shown in FIG. 4, the bottom section 110 may feature a seal 135, which may be a food grade silicone O-ring seal. An interior of the bottom section 110 may also include a heating element 220. The heating element 220 may feature a ceramic material, such as a porous ceramic material, and an embedded coil 250, where the embedded coil 250 may be comprised of a heat resistant wire, such as a Kanthal® wire embedded in the ceramic material. The heating element 220 may be seated on a sleeve 260, which may be a metal sleeve, and an airway 215 may pass through the heating element 220. In addition, the heating element 220 may further include a ceramic protector 230 having an upper region 410 that may prevent dissipation of heat into the middle section 150 of the adjustable airflow cartridge 400. In particular, the ceramic protector 230 surrounds the heating element 220 with embedded coil 250. The ceramic protector 230 may provide protection for the oil or resin within the adjustable airflow cartridge 400 that is heated for vaping. In one embodiment, the ceramic protector 230 may be comprised of a hard ceramic material such as zirconium nitride.

The embodiment of FIG. 4 shows a ceramic protector 230 that shields the oil or resin, so that there is no contact between the radiant heat and the oil or resin, thereby protecting against absorbance trace hard metals into the oil or resin. The absence of contact between the radiant heat and the oil or resin also prevents "spit backs," which occur when a heated coil within the adjustable airflow cartridge 400 emits hot droplets of oil or resin toward the mouthpiece during vaping by a user. In the embodiment of FIG. 4, the embedded coil 250 may be embedded and surrounded by a ceramic material, such as zirconium nitride, to prevent the oil or resin from heating too quickly, causing a "spit back."

Referring again to the embodiment of FIG. 4, the structure of the adjustable airflow cartridge 400 may further include the middle section 150 with quartz glass housing 152 encasing a tank 155 for maintaining a liquid or vape oil. Within the middle section 150, a center tube 160, which may be comprised of quartz glass, may extend through the tank 155 to provide an airway extending from the bottom section 110 to a mouthpiece at a top section of the adjustable airflow cartridge 400. Based on the quartz-glass composition of the mouthpiece of the top section and the whole tank 155 of the middle section 150, including both the quartz glass housing 152 and quartz glass center tube 160, metal elements do not contact the liquid or vape oil within the adjustable airflow cartridge 400.

Although not shown in FIG. 4, it is understood that the adjustable airflow cartridge 400 as shown in the embodiment of FIG. 4 may also feature a top section, as shown in FIGS. 1 through 3, comprising a mouthpiece 185 with quartz-glass housing 182. The quartz-glass housing of the top and middle sections 152, 182 may extend and adjoin to the metallic exterior 120 of the bottom section 110, where the metallic portions of the adjustable airflow cartridge 400 may comprise a ceramic coating featuring a range of thickness of 1-2 microns. As aforementioned, the range of thickness of the ceramic coating may be larger than 1-2 microns, or it may be smaller than 1-2 microns. The ceramic coating of the embodiments of FIG. 4 may also comprise a zirconium nitride coating. In another embodiment, the metal components of the adjustable airflow cartridge 400 may be exclusively coated in a layer of zirconium nitride.

The bottom section of the adjustable airflow cartridge 400 may further include 510 threading 115 for screwing the adjustable airflow cartridge 400 into a battery, along with a portion 125 featuring an adjustable air flow collar 130 comprising one or more adjustable intake air apertures, where such portion 125 may be twisted or rotated by a user to adjust the amount of airflow through the one or more adjustable intake air apertures. More specifically, as a user rotates or twists the portion 125 of the bottom section 110 featuring an adjustable air flow collar 130 comprising one or more adjustable intake air apertures, a user may adjust the size of the one or more adjustable intake air apertures to determine an amount of air passing through the one or more adjustable intake air apertures. At a point when a user draws air through the mouthpiece 185 (see FIGS. 1 through 3), air may travel through the one or more adjustable intake air apertures, through the atomizer and vape oil, through the quartz glass center tube 160 of the middle section 150, and to the mouthpiece 185 of the top section 180 of the adjustable airflow cartridge 400. By controlling and determining the level of airflow through the one or more adjustable intake air apertures of the bottom section 110, a user can customize an experience with an electronic vaporizer. As further illustrated in FIG. 4, the bottom section 110 of the adjustable airflow cartridge 200 may also feature a bearing element 210 that may facilitate rotation of an adjustable air flow collar 130 by a user.

Figure 5:
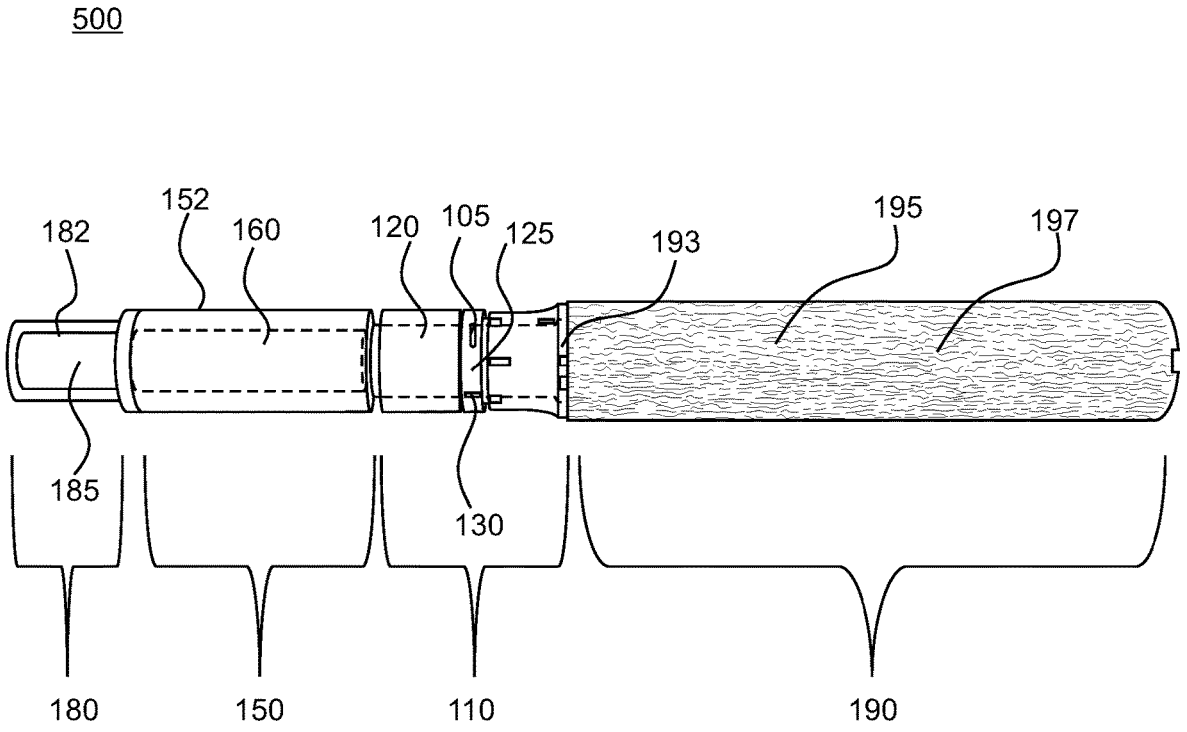
FIG. 5 shows a perspective view of an adjustable airflow cartridge of the herein described embodiments that is coupled to a vaporizer pen.

Referring to FIG. 5, an adjustable airflow cartridge 500 of the herein described embodiments is shown that is coupled to a vaporizer pen 190. The vaporizer pen 190 comprises a housing 195 that encases a battery 197. The adjustable airflow cartridge 500, with top section 180, middle section 150, and bottom section 110, may couple to the vaporizer pen 190 at an attachment point 193 by screwing the adjustable airflow cartridge 500 into the battery 197 with 510 threading disposed on the bottom section 110 of the adjustable airflow cartridge 500.

In the adjustable airflow cartridges of the herein descried embodiments, it is understood that a portion of the bottom section 110 of the adjustable airflow cartridge may feature an adjustable air flow collar 130 comprising one or more adjustable intake air apertures 105. The size of such one or more adjustable intake air apertures 105 may be adjusted by a user by rotating or twisting the portion 125 of the bottom section 110 featuring the adjustable air flow collar 130 comprising the one more adjustable intake air apertures 105. When rotating or twisting the portion 125 of the bottom section 110 featuring the adjustable air flow collar 130 having the one or more adjustable intake air apertures 105, a user may thereby adjust the size of the one or more air apertures 105. In addition, the one or more adjustable intake air apertures 105 may be adjusted reciprocally between larger apertures 105 providing increased airflow and smaller apertures 105 providing decreased airflow. The one or more adjustable intake air apertures 105 of the herein described embodiments of the adjustable airflow cartridge may enable a user to determine the passage of the airflow through the one or more adjustable intake air apertures 105, through the heating element 220 and vape oil, through the center tube 160 of the middle section 150, and through the mouthpiece 185 of the top section 180 of the cartridge. By determining the airflow, a user may control the resulting vapor production and vapor flavor produced by an electronic vaporizer. The adjustable airflow cartridge of the herein described embodiments may provide flexibility and customizability by enabling a user to selectively determine a desired airflow, based upon the ability to reciprocally adjust between sizes of the one or more adjustable intake air apertures 105 within the housing 120 of the bottom section 110 of the cartridge.

It is further understood that additional embodiments of the adjustable airflow cartridge may enable a user to adjust the size of the one or more adjustable intake air apertures 105. For example, in one embodiment, a cartridge may feature a slidable collar that a user may slide up and down the exterior housings 120, 152 of the cartridge to increase or decrease the size of the adjustable intake air apertures 105. In another embodiment, the cartridge may feature a lever that rotates a cover for the adjustable intake air apertures 105, thereby increasing or decreasing the size of the one or more adjustable intake air apertures 105.

It is further understood that each of the metal components of the adjustable airflow cartridge of the embodiments described herein may be coated with a particular ceramic, such as zirconium nitride to coat and cover the metal components of the cartridge with a material that prevents transmission of metal elements to the vapors inhaled by the user. Such components are not limited to a mouthpiece of a vaporizer, the top, middle and bottom sections of an adjustable airflow cartridge, and the various component sub-parts that may comprise such portions of a vaporizer and adjustable airflow cartridge.

Although features and elements are described above in particular combinations, each feature or element can be used alone without the other features and elements or in various combinations with or without other features and elements.

What is claimed is:

1. An adjustable airflow cartridge for vaporizing liquids comprising:

a monolithic quartz glass housing comprising:

a quartz glass mouthpiece;

a quartz glass tank that includes a quartz glass center tube extending from the mouthpiece through the quartz glass tank, the mouthpiece, tank and center tube each stationary within the housing;

a bottom section including a metallic housing containing a heating element;

a silicon sealing element in contact with a bottom end of the quartz glass center tube and a bottom end of the quartz glass tank and that separates the quartz glass tank from the bottom section and heating element;

at least one adjustable air intake aperture, and a rotatable portion that when rotated is configured to increase or decrease a size of the at least one adjustable air intake aperture, wherein an amount of air flows through the adjustable airflow cartridge from the bottom section to the quartz glass mouthpiece by flowing through the at least one adjustable air intake aperture, through the heating element, and through the quartz glass center tube to the quartz glass mouthpiece, wherein the amount of air flowing through the at least one adjustable air intake aperture may be adjusted based upon a rotation of the rotatable portion.

2. The adjustable airflow cartridge of claim 1, wherein the bottom section further comprises a threaded portion configured to couple the cartridge to a battery.

3. The adjustable airflow cartridge of claim 1, wherein the heating element further comprises a porous ceramic material.

4. The adjustable airflow cartridge of claim 1, wherein the heating element further comprises a ferritic iron-chromium-aluminum (FeCrAl) alloy wire embedded in a porous ceramic material.

5. A detachable electronic vaporizer cartridge for vaporizing liquids comprising:

a monolithic quartz glass housing comprising:

a quartz glass mouthpiece;

a quartz glass tank that includes a quartz glass center tube extending from the mouthpiece through the quartz glass tank, the mouthpiece, tank and center tube each stationary within the housing;

a bottom section comprising:

a metallic housing, a heating element contained in the metallic housing, at least two air intake apertures, and a threaded portion, and a silicon sealing element in contact with a bottom end of the quartz glass center tube and a bottom end of the quartz glass tank and that separates the quartz glass tank from the bottom section and heating element, wherein an amount of air flows through the detachable electronic vaporizer cartridge from the bottom section to the quartz glass mouthpiece by flowing through the at least two air intake apertures, through the heating element, and through the quartz glass center tube to the quartz glass mouthpiece, and wherein the amount of air flowing through the cartridge is based on the size of the at least two air intake apertures.

6. The detachable electronic vaporizer cartridge of claim 5, wherein the threaded portion is configured to couple the detachable electronic vaporizer cartridge to a battery.

7. The detachable electronic vaporizer cartridge of claim 5, wherein the heating element further comprises a porous ceramic material.

8. The detachable electronic vaporizer cartridge of claim 5, wherein the heating element further comprises aa ferritic iron-chromium-aluminum (FeCrAl) alloy wire embedded in a porous ceramic material.

9. The detachable electronic vaporizer of cartridge of claim 5, wherein the bottom section further comprises as silicon O-ring seal that is configured to prevent oil from leaking out of the tank.

* * * * *